US005759978A

United States Patent [19]

Welch et al.

[11] Patent Number: 5,759,978

[45] Date of Patent: Jun. 2, 1998

[54] NON-PHOSPHATE MACHINE DISHWASHING COMPOSITIONS CONTAINING POLYCARBOXYLATE POLYMERS AND POLYALKYLENE OXIDE HOMOPOLYMERS

[75] Inventors: Michael C. Welch, Woodhaven; Kenneth L. Zack, Wyandotte, both of Mich.

[73] Assignee: BASF Corporation, Mount Olive, N.J.

[21] Appl. No.: 568,059

[22] Filed: Dec. 6, 1995

[51] Int. Cl.[6] ..... C11D 3/37; C11D 3/39; C11D 3/395

[52] U.S. Cl. ..... 510/230; 510/226; 510/229; 510/374; 510/376; 510/378; 510/476; 510/506

[58] Field of Search ..... 510/230, 223, 510/318, 360, 361, 398, 434, 476, 506, 533, 226, 229, 374, 376, 378

[56] References Cited

U.S. PATENT DOCUMENTS

| | | | |
|---|---|---|---|
| 4,490,271 | 12/1984 | Spadini et al. | 510/352 |
| 4,657,693 | 4/1987 | Wise et al. | 510/453 |
| 4,861,511 | 8/1989 | Kaplan | 510/193 |
| 5,049,303 | 9/1991 | Secemski et al. | 510/356 |
| 5,415,806 | 5/1995 | Pepe et al. | 8/137 |
| 5,496,376 | 3/1996 | Falotico et al. | 510/349 |
| 5,565,420 | 10/1996 | Stearns | 510/358 |

FOREIGN PATENT DOCUMENTS

| | | |
|---|---|---|
| 0014980 | 2/1983 | European Pat. Off. . |
| 0 208 534 | 1/1987 | European Pat. Off. . |
| 1807779 | 6/1970 | Germany . |
| 1807782 | 6/1970 | Germany . |
| 2840463 C2 | 12/1983 | Germany . |
| 92/06153 | 4/1992 | WIPO . |

*Primary Examiner*—Ardith Hertzog
*Attorney, Agent, or Firm*—Joanne P. Will

[57] ABSTRACT

An improved non-phosphate, peroxygen based machine dishwashing composition comprising a blend of nonionic surfactants, builders, non-chlorine bleach, bleach precursors, enzymes, polycarboxylate polymers and homopolymers of polyalkyleneoxide wherein spotting and filming are substantially minimized.

22 Claims, No Drawings

NON-PHOSPHATE MACHINE DISHWASHING COMPOSITIONS CONTAINING POLYCARBOXYLATE POLYMERS AND POLYALKYLENE OXIDE HOMOPOLYMERS

FIELD OF THE INVENTION

This invention relates to improved powdered non-phosphate dishwashing compositions containing polycarboxylate polymers and polyalkyleneoxide homopolymers.

BACKGROUND OF THE INVENTION

Machine dishwashing formulations generally contain inorganic phosphate salts as builders to sequester calcium and magnesium ions in water to minimize filming of dishware. These formulations also contain available chlorine compounds which improve stain removal, sanitize dishes and help minimize the spotting and filming on dishware.

Because of environmental considerations associated with the use of phosphates as builders, formulations have been developed without phosphate compounds. Non-phosphate formulations generally contain salts of low molecular weight organic acids, such as sodium citrate, as builders. Since citrate is not as effective as phosphate, other additives known to the art, such as polymers of acrylic acid, are used to minimize the increase in spotting and filming that occurs with non-phosphate formulations.

Detergent compositions containing polyalkylene oxide polymers are also known to the detergent art. Specifically, DE 28,40,463, published Dec. 22, 1983 (assigned to Henkel), discloses the use of a liquid agent based on aqueous solutions of surface-active agents, structural substances and organic polymers that contain synthetic anionic surface-active agents, soaps or nonionic surface-active agents or their mixtures in quantities of 1 to 30% by weight. Preferably the organic polymers are 0.08 to 0.4% by weight of water-soluble polyethyleneglycols, with high molecular weight of between 300,000 and 4,000,000, preferably between 500,000 and 1,000,000 for cleaning hard surfaces.

DE 1807779 and DE 1807782, both published Jun. 4, 1970, (both assigned to Henkel) disclose low-foaming rinsing and washing agents to be used in dishwashers comprising (A) 70–98% by weight of polyoxyethyleneglycol with high molecular weights of 5,000–4,000,000 and (B) 2–30% by weight of boundary surface-active compounds of foam inhibitors.

EPO 014 980 (DE2906891) published Feb. 16, 1983 (assigned to Henkel), discloses combined washing and rinsing agents comprising:

20–55% of a water-soluble, condensed alkali phosphate,

30–60% of an alkali metasilicate,

2–15% of an alkali hydroxide and/or an alkali carbonate,

0–8% of a water-soluble alkali silicate,

1–10% of an active-chlorine containing compound, 0.5–5% of an ethoxylated and subsequently propoxylated fatty alcohol, 0.2–2.5% of a water soluble, high molecular weight polyethyleneglycol (molecular weight of between 300,000 and 4,000,000, preferably between 500,000 and 1,000,000);

U.S. Pat. No. 5,049,303, issued Sep. 17, 1991 (assigned to Lever Bros.), discloses a detergent composition comprising:

(a) from 5% to about 50% by weight of an organic surfactant selected from the group consisting of anionic, cationic, nonionic, zwitterionic and amphoteric surfactants, and mixtures thereof;

(b) from 5% to about 80% by weight of a nonphosphorous detergent builder; and (c) from about 1% to about 30% of a mixture of an ethylene oxide/propylene oxide block copolymer and a polycarboxylate, in which mixture the ethylene oxide/propylene oxide block copolymer: polycarboxylate weight ratio is from about 1:10 to about 10:1, said ethylene oxide/propylene oxide block copolymer having a weight average molecular weight of from about 1,000 to about 50,000.

However, none of these references disclose the use of polycarboxylate polymers and polyalkyleneoxide homopolymers in totally, nonionic surfactant containing, non-phosphate automatic dishwashing compositions. Further, the presently available non-phosphate formulations, while environmentally sound, are not as effective in preventing spotting and filming. It has now been surprisingly discovered that the addition of polycarboxylate polymers and lower molecular weight polyalkylene oxide homopolymers to automatic dishwashing compositions dramatically minimizes the spotting and filming of non-phosphate machine dishwashing compositions while remaining environmentally sound.

SUMMARY

The present invention relates to improved non-spotting and non-filming, non-phosphate, peroxygen based machine dishwashing compositions comprising a blend of nonionic surfactants, non-phosphate builders, non-chlorine bleach, bleach precursors, enzymes, and polycrboxylate polymers and polyalkyleneoxide homopolymers wherein said polycarboxylate polymer has a molecular weight of about 500–250,000 and the structural formula:

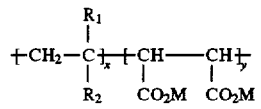

$R_1$=H or $CH_3$;$R_2$=$CO_2M$; M=H or alkali metal; x=7–1500;y=0–1000 wherein further, said polyalkyleneoxide homopolymer has a molecular weight of about 100–20,000 and the structural formula:

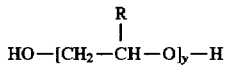

wherein y=2–500;

R=H; $CH_3$ or $CH_2CH_3$.

DETAILED DESCRIPTION

The compositions of the present invention are non-spotting and non-filming, non-phosphate, peroxygen based machine dishwashing compositions comprises a blend of nonionic surfactants, builders, non-chlorine bleach, bleach precursors, bleach activators, enzymes, polycarboxylate polymers and polyalkleneoxide homopolymers wherein said polycarboxylate polymer has a molecular weight of about 500–250,000 and has the structural formula:

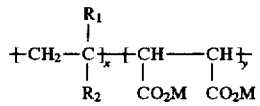

$R_1$=H or $CH_3$; $R_2$=$CO_2M$; M=H or alkali metal; x=7–1500; y=0–1000 wherein further, said polyalkyleneoxide homopolymer has a molecular weight of about 100–20,000 and the structural formula:
wherein y=2–500;

R=H; $CH_3$ or $CH_2CH_3$.

NONIONIC SURFACTANTS

The dishwashing compositions of the present invention contain nonionic surfactants at levels of 0 to 15% by weight, preferably 0.1 to 10% by weight; most preferably 1 to 6% by weight. Nonionic surfactants can be broadly defined as surface active compounds which do not contain ionic functional groups. An important group of chemicals within this class are those produced by the condensation of alkylene oxide groups (hydrophilic in nature) with an organic hydrophobic compound; the latter is aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Illustrative, but not limiting, examples of the various chemical types of suitable nonionic surfactants include:

(a) polyoxyalkylene (polyoxyethylene or polyoxypropylene) condensates of aliphatic carboxylic acids, whether linear or branched-chain and unsaturated or saturated, containing from about 8 to about 18 carbon atoms in the aliphatic chain and incorporating from 5 to about 50 ethylene oxide or propylene oxide units. Suitable carboxylic acids include "coconut" fatty acids (derived from coconut oil) which contain an average of about 12 carbon atoms, "tallow fatty acids (derived from tallow-class fats) which contain an average of about 18 carbon atoms, palmitic acid, myristic acid, stearic acid and lauric acid.

(b) polyoxyalkylene (polyoxyethylene or polyoxypropylene) condensates of aliphatic alcohols, whether linear- or branched- chain and unsaturated or saturated, containing from about 8 to about 24 carbon atoms and incorporating from about 5 to about 50 ethylene oxide or propylene oxide units. Suitable alcohols include the "coconut" fatty alcohol, "tallow" fatty alcohol, lauryl alcohol, myristyl alcohol and oleyl alcohol. INDUSTROL® DW5 surfactant is a preferred polyoxyalkylene condensate of an aliphatic alcohol type surfactant which is available from BASF Corporation, Mt. Olive, N.J.

(c) polyoxyalkylene (polyoxyethylene or polyoxypropylene) condensates of alkyl phenols, whether linear- or branched-chain and unsaturated or saturated, containing from about 6 to about 12 carbon atoms and incorporating from about 5 to about 25 moles of ethylene oxide or propylene oxide.

(d) Particularly preferred nonionic surfactants are selected polyalkylene oxide block copolymers. This class can include polyethoxylated-polypropoxylated propylene glycol sold under the tradename "PLURONIC®" made by the BASF Corporation or polypropoxylated-polyethoxylated ethylene glycol sold under the tradename "PLURONIC-R®" made by the BASF Corporation, Mt. Olive, N.J. The first group of compounds are formed by condensing ethylene oxide with a hydrophobic base formed by the condensation of propylene oxide with propylene glycol (see U.S. Pat. No. 2,674,619). The hydrophobic portion of the molecule which, of course, exhibits water insolubility, has a molecular weight from about 1500 to 1800. The addition of the polyoxyethylene radicals to this hydrophobic portion tends to increase the water solubility of the molecule as a whole and the liquid character of the product is retained up to the point where the polyoxyethylene content is about 50 percent of the total weight of the condensation product. The latter series of compounds called "PLURONIC-R®" are formed by condensing propylene oxide with the polyethoxylated ethylene glycol condensate. This series of compounds is characterized by having an average molecular weight of about between 2000 and 9000 consisting of, by weight, from about 10 to 80 percent polyoxyethylene, and a polyoxypropylene portion having a molecular weight between about 1000 and 3100.

U.S. Pat. Nos. 4,366,326; 4,624,803; 4,280,919; 4,340,766; 3,956,401; 5,200,236; 5,425,894; 5,294,365; incorporated by reference herein, describe in detail nonionic surfactants useful in the practice of this invention. *Surfactant Science Series,* edited by Martin J. Schick, Nonionic Surfactants, Vols. 19 and 23 provide detailed description of nonionic surfactants and are incorporated by reference herein. Finally, surfactant blends prepared from the surfactants described herein can be used in the practice of the present invention.

ANTIFOAMERS

The compositions of the present invention may contain anti-foaming agents. Preferred anti-foaming agents are silicone anti-foaming agents used at a level of 0.2–1.0% by weight. These are alkylated polysiloxanes and include polydimethyl siloxanes, polydiethyl siloxanes, polydibutyl siloxanes, phenyl methyl siloxanes, diethylsilanated silica. Other suitable anti-foaming agents are sodium stearate used at a concentration level of about 0.5 to 1.0% by weight, monostearyl acid phosphate used at a concentration level of about 0 to about 1.5% by weight, more preferably about 0.1 to about 1.0% by weight.

NON-PHOSPHATE BUILDERS

The dishwashing compositions of the present invention also contain approximately 2–40% by weight, preferably 4–40% by weight, more preferably 5–30% by weight, of non-phosphate builders such as, but not limited to various water-soluble, alkali metal, ammonium or substituted ammonium carbonates, and silicates. Preferred are the alkali metal carbonates, especially the sodium salts.

Specific examples of nonphosphorous, inorganic builders are sodium and potassium carbonate, bicarbonate, sesquicarbonate, tetraborate decahydrate, and silicate.

Water-soluble, non-phosphate organic builders useful herein also include non-polymeric polycarboxylates. Examples of non-polymeric polycarboxylate builders are the sodium, potassium, lithium, ammonium and substituted ammonium salts of ethylenediametetraacetic acid, nitrilotriacetic acid, oxydisuccinic acid, mellitic acid, benzene polycarboxylic acids, citric acid, and methyl glycine diacetic acid ("MGDA").

Other useful builders are sodium and potassium carboxymethyloxymalonate, carboxymethyloxysuccinate, cis-cyclo- hexanehexacarboxylate, cis-cyclopentanetetracarboxylate, and phloroglucinol trisulfonate.

Additional suitable non-polymeric polycarboxylates are the polyacetyl carboxylates described in U.S. Pat. No. 4,144,226, issued Mar. 13, 1979 to Crutchfield, et al, and U.S. Pat. No. 4,246,495 issued Mar. 27, 1979 to Crutchfield, et al, both incorporated herein by reference.

Further, other detergency builder materials useful herein are the "seeded builder" compositions disclosed in Belgian Patent No. 798,856, issued Oct. 29, 1973, incorporated herein by reference. Specific examples of such seeded builder mixtures are: 3.1 wt. mixtures of sodium carbonate and calcium carbonate having 5 micron particle diameter, 2.7:1 wt. mixtures of sodium sesquicarbonate and calcium carbonate having a particle diameter of 0.5 microns; 20:1 wt. mixtures of sodium sesquicarbonate and calcium hydroxide having a particle diameter of 0.01 calcium hydroxide having a particle diameter of 0.01 micron and a 3:3:1 wt. mixture of sodium carbonate, sodium aluminate and calcium oxide having particle diameter of 5 microns.

Complete descriptions of useful non-phosphate builders useful in the practice of this invention, are described in EP 0,358,474B, U.S. Pat. No. 5,049,303, EP 0 358,472 A, incorporated by reference herein.

NON-CHLORINE BLEACH COMPOUNDS AND BLEACH PRECURSORS

The compositions of the present invention contain certain non-chlorine bleach compounds such as, but not limited to, organic peroxy acids and diacyl peroxides. Said non-chlorine bleach compounds are present at a level of 0 to 20% by weight; preferably from 5 to 15% by weight; more preferably from 6 to 10% by weight. The peroxy acids usable in the present invention are solid compounds and substantially stable in the temperature range of about 40° C. to about 50° C.

Typical monoperoxy acids useful herein include alkylperoxy acids and arylperoxy acids such as:

(i) peroxybenzoic acid and ring-substituted peroxybenzoic acids, e.g. peroxy-alpha-naphthoic acid, and magnesium monoterphtalate.

(ii) aliphatic and substituted aliphatic monoperoxy acids, e.g. peroxylauric acid, peroxystearic acid and 6-(N-phtyalimido)peroxyhexanoic acid. Typical diperoxy acids useful herein include alkyldiperoxy acids and aryldiperoxy acids, such as:

(iii) 1,1 2-diperoxydodecanedoic acid (iv) 1,9-diperoxyazelalic acid (v) diperoxybrassylic acid; diperoxysebacic acid and diperoxysiophthalic acid (vi) 2-decyldiperoxybutane- 1,4 dioic acid.

A typical diacylperoxide is dibenzoylperoxide.

Inorganic peroxygen compounds may also be suitable.

Examples of these materials are salts of monopersulfate, perborate monohydrate, perborate tetrahydrate, and percarbonate.

Examples of suitable chlorine-free oxygen donating bleaches also include perhydrates and peroxy compounds, as well as mixtures thereof. Perhydrates preferably include alkali metal compounds of perborates in the form of tetra- or monohydrates, perborax, percarbonates, persilicates, citrate perhydrates as well as perhydrates of urea and melamine compounds. Furthermore, acidic persalts, such as persulphates (e.g. caroates), perbenzoates, and peroxycarboxylic acids, such as peroxyphthalate, magnesium monoperoxyphthalic acid, diperoxyphthalic acid, 2-octyl-diperoxy- succinic acid, diperoxydodecane dicarboxylic acid, diperoxyazelaic acid, amidoperoxycarboxylic acid, as well as salts and mixtures thereof.

Particularly preferred non-chlorine bleaches are sodium percarbonate and sodium perborate.

PEROXYGEN BLEACH PRECURSORS

Peroxygen bleach precursors are compounds which react in the bleaching solution with hydrogen peroxide from an inorganic peroxygen source to generate an organic peroxy acid. They are also susceptible to hydrolysis and cannot normally be formulated directly into aqueous cleaning compositions. Precursors would be incorporated into products along with a source of hydrogen peroxide, which also could optionally be encapsulated. Bleach precursors are present at a level of 0 to 7% by weight; preferably 1 to 5% by weight; more preferably 3 to 5% by weight.

Precursors for peroxy bleach compounds have been amply described in the literature, including in British Nos. 836,988; 855,735; 907,358; 907,950; 1,003,310 and 1,246,339; U.S. Pat. Nos. 3,332,882 and 4,128,494; Canadian No. 844,481 and South African No. 68/6,344.

Typical examples of precursors are polyacylated alkylene diamines, such as N,N,N,N,-tetracetylethylene diamine (TAED) and N,N,N',N'-tetracetylmethylene diamine (TAMD); acrylated glycolurils, such as tetracetylglycoluril (TAGU); triacetylcyanurate, sodium sulphophenyl ethyl carbonic acid ester, sodium acetyloxbenzene sulfonate (SABS), sodium nonanoyloxbenzene sulfonate (SNOBS) and choline sulfophenyl carbonate. TAED is a preferred bleach precursor.

Peroxybenzoic acid precursors are known in the art, e.g. from GB-A-836988. Examples thereof are phenylbenzoate; phenyl p-nitrobenzoate; o-nitrophenyl benzoate; o-carboxyphenyl benzoate; p-bromobenyl benzoate; sodium or potassium benzoyloxybenzensulfonate; and benzoic anhydride.

Other suitable precursors are described in U.S. Pat. No. 4,711,748 and U.S. Ser. No. 07/497,709 filed on Mar. 16, 1990 by Batal et al describing N-sulfonyloxyziridine compounds and U.S. Ser. No. 07/494,713, filed on Mar. 16, 1990 by Batal et al describing sulfonamine compounds herein incorporated by reference. The activators may be admixed with, or absorbed upon other compatible ingredients.

Suitable bleach precursors are also described in U.S. Pat. No. 5,200,236; 5,151,212; 4,619,779; incorporated by reference herein.

ENZYMES

The compositions of the present invention may also contain enzymes, such as but not limited to, lipases, amylases and proteases. Proteases such as Purafect Oxam®, Maxamill®, Purafect®, Purafect OXP®, Maxacal®, Maxapem®, Maxatase®, are available from Genencor; amylases such as Termamyl®, and Lumafast®, are also available from Genencor; and proteases such as Alcalase®, Savinase® and Esperase® are available from Novo Industries A/S. Proteases are present at a level of 0.5 to 10% by weight; preferably 0.7 to 9% by weight; most preferably 0.8 to 8% by weight; amylases are present at a level of 0.3 to 10% by weight, preferably 0.4 to 9% by weight; most preferably 0.5 to 8% by weight; lipases are present at a level of 0 to 8% by weight.

Further, U.S. Pat. No. 5,173,207 and 5,240,633 describe enzymes useful in the practice of this invention and are incorporated by reference herein.

FILLERS

An inert particulate filler material which is water-soluble may also be present in cleaning compositions in powder form. This material should not precipitate calcium or magnesium ions at the filler use level. Suitable for this purpose are organic or inorganic compounds. Organic fillers include sucrose esters and urea. Representative inorganic fillers include sodium sulfate, sodium chloride and potassium chloride. A preferred filler is sodium sulfate. Its concentration may range from 0% to 60%, preferably from about 10% to about 30% by weight of the cleaning composition.

OPTIONAL INGREDIENTS

Additionally, one skilled in the art understands that small amounts of perfumes, colorants and antibacterial agents may be added to the dishwashing detergent compositions of the present invention.

POLYCARBOXYLATE POLYMERS AND POLYALKYLENE OXIDE HOMOPOLYMERS

Finally, the dishwashing compositions of the present invention contain polycarboxylate polymers and homopolymers of polyalkyleneoxides wherein said polycarboxylate polymer has a molecular weight of 500–250,000 and the structural formula:

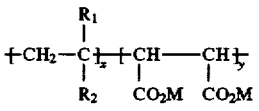

$R_1$=H or $CH_3$; $R_2$=$CO_2M$; M=H or alkali metal; x=7–1500; y=0–1000. The polycarboxylates comprise homopolymers or copolymers of acrylic acid, methacrylic acid, maleic acid, fumaric acid, itaconic acid, and the like. They may be polyacrylic acid, polymethacrylic acid, or a copolymer of acrylic and methacrylic acids, said homopolymer or copolymer may range in molecular weight from about 500 up to about 250,000 depending on the degree of crosslinking.

While the preparation of polyacrylates from acrylic acid and methacrylic acid monomers is well known in the art and need not be detailed here, the following will illustrate the general technique that can be used.

The polymerization of acrylic acid to polyacrylate acid can be stopped at any appropriate molecular weight (determined by viscosity). The conditions under which it is polymerized will result in different performance characteristics for similar molecular weight polymers. If, for example, the polymerization took place under a condition of a high temperature (100°–150° C.), there will be a strong tendency for crosslinking to occur. Crosslinking is undesirable as it decreases the apparent acid strength of the polyacid by preventing the expansion of the molecules, which would otherwise increase the separation between carboxylic groups. This results in two distinct adverse effects. First, the solubility of the polymer is reduced and, second, the chelation ability is reduced. It should be noted that the higher the molecular weight, the more likely extensive crosslinking occurs. It is, however, possible to produce polyacrylic acid having molecular weights in the millions without extensive crosslinking by reacting the monomers under very mild conditions.

Water soluble salts of acrylic acid and methacrylic acid homopolymers as described above are especially preferred for the purposes of the invention. The water soluble salt can be an alkali metal, ammonium or substituted (quaternary) ammonium salt. The alkali metal can be sodium or potassium. The sodium salt is preferred. The salt can be used in a partially or fully neutralized form. Also, partial neutralization and esterification of the carboxylic acid groups can be carried out while still retaining the effective properties of the homopolymer. The homopolymers are converted to the desired salt by reaction with the appropriate base, generally with a stoichiometric excess of the desired percent of conversion. Normally 100 percent of the carboxyl groups present will be converted to the salt, but the percentage can be less in certain situations. In general, the polycarboxylate polymers will have a molecular weight of from about 500 to 250,000, preferably about 500 to 70,000, even more preferably, about 1,000 to 20,000 and, most preferably, about 1,000 to 10,000.

A preferred water soluble polycarboxylate polymer useful in the present invention is a sodium salt of polyacrylic acid, having a molecular weight of 500–250,000; more preferably 500–70,000; most preferably 1,000 to 20,000. The polycarboxylate polymers are used at levels of 0.1–10% by weight; preferably 0.1–8% by weight; most preferably 1–6% by weight.

Wherein further, said polyalkyleneoxide homopolymer has a molecular weight of about 100–20,000 and the structural formula:

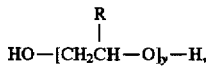

wherein y=2–500 and R=H; $CH_3$ or $CH_2CH_3$.

Polyalkyleneoxide homopolymers are formed from repeating alkylene oxide units. In the present invention, R can be H; $CH_3$; or $CH_2CH_3$. Further, when R is H, the alkylene oxide unit is ethylene; when R is $CH_3$, the alkylene oxide unit is propylene oxide; when R is $CH_2CH_3$, the alkylene oxide unit is butylene oxide. The preferred R is H and, thus, the preferred alkylene oxide unit is ethylene oxide.

y indicates the number of times, i.e., 2–500 times, that the alkylene oxide unit may be repeated to produce a polymer of about 100–20,000 in molecular weight. The preferred molecular weight range is about 1000–10,000 and the most preferred is about 4000–8000 molecular weight.

Thus, the preferred polyalkylene oxide homopolymer of the present invention is:

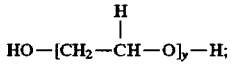

y=35–350 repeating alkylene oxide units and R=H.

Polethylene Oxide of MW 1000–10,000

The most preferred polyalkylene oxide homopolymer of the present invention is:

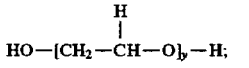

wherein y=140–280 repeating alkylene oxide units and R=H.

Polyethylene Oxide of MW 4000–8000

The polyalkylene homopolymers of the present invention are present at a level of 0.1 to 10% by weight; preferably at a level of 0.1 to 8% by weight; more preferably at a level of 1 to 6% by weight.

The powdered machine dishwashing detergents of the present invention are prepared according to procedures known to those skilled in the art. The procedure described in U.S. Pat. No. 5,423,997 specifically describes the detergent making process, useful in making compositions of the present invention, and is incorporated by reference herein.

TESTING OF THE COMPOSITIONS OF THE PRESENT INVENTION

The compositions described in Examples 1,2, 3, and 4 were evaluated using the following test method:

Five glasses were evaluated after three wash/rinse cycles, in a Gibson Model SP 24 dishwasher, using 200 ppm hardness water. Cycle 1: 20 grams detergent in the prewash, 25 grams fat soil in the prewash, 20 grams detergent in the main wash; Cycle 2: Repeat Cycle 1, add 12 grams powdered milk to main wash; Cycle 3: repeat Cycle 1, add 15 grams raw egg to main wash.

The fat soil test sample is prepared by blending 72% margarine, 18% powdered milk, 5% lard, and 5% rendered beef tallow.

The following Examples further describe and demonstrate the present invention. The Examples are given solely for the purpose of illustration, and are not to be construed as limitations of the present invention.

Example 1 contains no polymer, Example 2 contains a homopolymer of acrylic acid, and Examples 3 and 4 contain only homopolymers of polyethylene oxide, Examples 5 and 6 contain polymers useful in the practice of the present invention.

EXAMPLE 1

No polymer was used.

EXAMPLE 2

2% neutralized 8000 molecular weight polymer of acrylic acid suitable for use in machine dishwashing compositions was used.

4% nonionic surfactant (INDUSTROL® DW5)

10% sodium carbonate

25% sodium metasilicate pentahydrate

10% sodium perborate

49% sodium sulfate

EXAMPLE 3

2% 4000 molecular weight polyethylene oxide was used.

4% nonionic surfactant (INDUSTROL® DW5)

10% sodium carbonate

25% sodium metasilicate pentahydrate

10% sodium perborate

49% sodium sulfate

EXAMPLE 4

2% 8000 molecular weight polyethylene oxide was used.

4% nonionic surfactant (INDUSTROL® DW5)

10% sodium carbonate

25% sodium metasilicate pentahydrate

10% sodium perborate

49% sodium sulfate

EXAMPLE 5

2% 4000 molecular weight homopolymer of polyethylene oxide

2% 8000 molecular weight polymer of acrylic acid

4% nonionic surfactant (INDUSTROL® DW5)

10% sodium carbonate

25% sodium metasilicate pentahydrate

10% sodium perborate

47% sodium sulfate

EXAMPLE 6

2% 8000 molecular weight homopolymer of polyethylene oxide

2% 8000 molecular weight polymer of acrylic acid

4% nonionic surfactant (INDUSTROL® DW5)

10% sodium carbonate

25% sodium metasilicate pentahydrate

10% sodium perborate

47% sodium sulfate

Table 1 serves to illustrate the superior benefits of the present invention over the prior art. Specifically, Examples 5 and 6, which are representatives of the invention described herein, show superior reduction in spotting and filming compared to Examples 1 and 2.

TABLE 1

| EXAMPLE | SPOTTING | FILMING |
|---|---|---|
| 1 | 3.0 | 4.5 |
| 2 | 2.0 | 3.0 |
| 3 | 1.8 | 5.0 |
| 4 | 1.6 | 5.0 |
| 5 | 1.7 | 2.2 |
| 6 | 1.3 | 2.1 |

What is claimed is:

1. A non-phosphate, peroxygen based machine dishwashing composition consisting of by weight:

(a) 0.1–10% nonionic surfactants, (b) 2–40% non-phosphate builders, (c) 5–15% non-chlorine bleach, (d) 1–5% peroxygen bleach precursors, (e) 0.1–10% polycarboxylate polymers wherein said polycarboxylate polymer has a molecular weight of 500–250,000 and the structural formula:

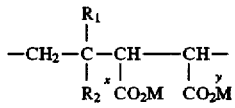

wherein $R_1$=H or $CH_3$; $R_2$=$CO_2M$; M=H or alkali metal; x=7–1500; y=0–1000;

(f) 0.1–10% polyalkyleneoxide homopolymers having a molecular weight of 100–20,000 and the structural formula:

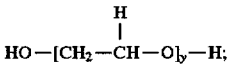

wherein: y=2–500; and R=H;$CH_3$ or $CH_2CH_3$ and (g) balance filler.

2. A dishwashing composition according to claim 1, wherein in (e), said polycarboxylate polymer has a molecular weight of 500–70,000 and the structural formula;

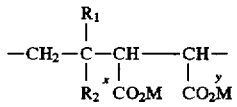

$R_1$=H or $CH_3$; $R_2$=$CO_2M$; M=H or alkali metal; x=7–1500; y=0–1,000.

3. A dishwashing composition according to claim 1, wherein in (f) said polyalkyleneoxide homopolymer has a molecular weight of 1,000–10,000 and the structural formula:

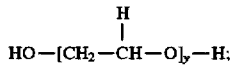

wherein: y=35–350.

4. A dishwashing composition according to claim 1, wherein in (e), said polycarboxylate polymer has a molecular weight of 1,000–20,000 and the structural formula:

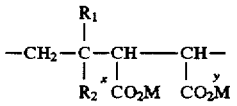

$R_1$=H or $CH_3$; $R_2$=$CO_2M$; M=H or alkali metal; x=7–1,500; y=0–1,000.

5. A dishwashing composition according to claim 1, wherein in (f), said polyalkylene oxide homopolymer has a molecular weight of 4,000–8, 000 and the structural formula:

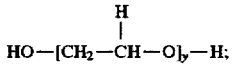

wherein: y=140–280.

6. A dishwashing composition according to claim 1, wherein:

(a) said nonionic surfactants are selected from the group consisting of polyoxyalkylene condensates of aliphatic alcohols and polyoxyalkyleneoxide block copolymers;

(b) said non-phosphate builders are selected from the group consisting of alkali metal salts of carbonate and bicarbonate, and silicate and citrate;

(c) said non-chlorine bleach is selected from the group consisting of perborate and percarbonate;

(d) said bleach precursors are selected from the group consisting of TAED and TAMD.

7. A dishwashing composition according to claim 2, wherein:

(a) said nonionic surfactants are selected from the group consisting of polyoxyalkylene condensates of aliphatic alcohols and polyoxyalkyleneoxide block copolymers;

(b) said non-phosphate builders are selected from the group consisting of alkali metal salts of carbonate and bicarbonate, and silicate and citrate;

(c) said non-chlorine bleach is selected from the group consisting of perborate and percarbonate;

(d) said bleach precursors are selected from the group consisting of TAED and TAMD.

8. A dishwashing composition according to claim 3, wherein:

(a) said nonionic surfactants are selected from the group consisting of polyoxyalkylene condensates of aliphatic alcohols and polyoxyalkyleneoxide block copolymers;

(b) said non-phosphate builders are selected from the group consisting of alkali metal salts of carbonate and bicarbonate, and silicate and citrate;

(c) said non-chlorine bleach is selected from the group consisting of perborate and percarbonate;

(d) said bleach precursors are selected from the group consisting of TAED and TAMD.

9. A dishwashing composition according to claim 4, wherein:

(a) said nonionic surfactants are selected from the group consisting of polyoxyalkylene condensates of aliphatic alcohols and polyoxyalkyleneoxide block copolymers;

(b) said non-phosphate builders are selected from the group consisting of alkali metal salts of carbonate and bicarbonate, and silicate and citrate;

(c) said non-chlorine bleach is selected from the group consisting of perborate and percarbonate;

(d) said bleach precursors are selected from the group consisting of TAED and TAMD.

10. A dishwashing composition according to claim 5, wherein:

(a) said nonionic surfactants are selected from the group consisting of polyoxyalkylene condensates of aliphatic alcohols and polyoxyalkyleneoxide block copolymers;

(b) said non-phosphate builders are selected from the group consisting of alkali metal salts of carbonate and bicarbonate, and silicate and citrate;

(c) said non-chlorine bleach is selected from the group consisting of perborate and percarbonate;

(d) said bleach precursors are selected from the group consisting of TAED and TAMD.

11. A non-phosphate, peroxygen based machine dishwashing composition consisting of by weight:

(a) 0.1–10% nonionic surfactants, (b) 2–40% non-phosphate builders, (c) 5–15% non-chlorine bleach, (d) 1–5% peroxygen bleach precursors, (e) 0.5–8% enzymes (f) 0.1–10% polycarboxylate polymers wherein said polycarboxylate polymer has a molecular weight of 500–250,000 and the structural formula:

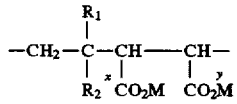

wherein $R_1$=H or $CH_3$; $R_2$=$CO_2M$; M=H or alkali metal; x=7–1,500; y=0–1,000;

(g) 0.1–10% polyalkyleneoxide homopolymers having a molecular weight of 100–20,000 and the structural formula:

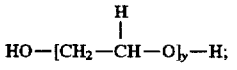

wherein: y=2–500; and R=H; $CH_3$ or $CH_2CH_3$; and (h) balance filler.

12. A dishwashing composition according to claim 11, wherein in (f) said polycarboxylate polymer has a molecular weight of 500–70,000 and the structural formula:

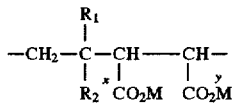

$R_1$=H or $CH_3$; $R_2$=$CO_2M$; M=H or alkali metal, x=7–1,500; y=0–1,000.

13. A dishwashing composition according to claim 11, wherein in (g) said polyalkyleneoxide homopolymer has a molecular weight of 1,000–10,000 and the structural formula:

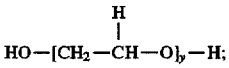

wherein: y=35–350.

14. A dishwashing composition according to claim 1, wherein in (f), said polycarboxylate polymer has a molecular weight of 1,000–20,000 and the structural formula:

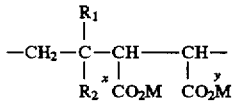

$R_1$=H or $CH_3$; $R_2$=$CO_2M$; M=H or alkali metal; x=7–1,500; y=0–1,000.

15. A dishwashing composition according to claim 11, wherein in (g), said polyalkylene oxide homopolymer has a molecular weight of 4,000–8,000 and the structural formula:

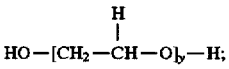

wherein: y=140–280.

16. A dishwashing composition according to claim 11, wherein:

(a) said nonionic surfactants are selected from the group consisting of polyoxyalkylene condensates of aliphatic alcohols and polyoxyalkyleneoxide block copolymers;

(b) said non-phosphate builders are selected from the group consisting of alkali metal salts of carbonate and bicarbonate, and silicate and citrate;

(c) said non-chlorine bleach is selected from the group consisting of perborate and perearbonate;

(d) said bleach precursors are selected from the group consisting of TAED and TAMD;

(e) said enzymes are selected from the group consisting of amylase, lipase and protease.

17. A dishwashing composition according to claim 12, wherein:

(a) said nonionic surfactants are selected from the group consisting of polyoxyalkylene condensates of aliphatic alcohols and polyoxyalkyleneoxide block copolymers;

(b) said non-phosphate builders are selected from the group consisting of alkali metal salts of carbonate and bicarbonate and silicate and citrate;

(c) said non-chlorine bleach is selected from the group consisting of perborate and percarbonate;

(d) said bleach precursors are selected from the group consisting of TAED and TAMD;

(e) said enzymes are selected from the group consisting of amylase, lipase and protease.

18. A dishwashing composition according to claim 13, wherein:

(a) said nonionic surfactants are selected from the group consisting of polyoxyalkylene condensates of aliphatic alcohols and polyoxyalkyleneoxide block copolymers;

(b) said non-phosphate builders are selected from the group consisting of alkali metal salts of carbonate and bicarbonate, and silicate and citrate;

(c) said non-chlorine bleach is selected from the group consisting of perborate and percarbonate;

(d) said bleach precursors are selected from the group consisting of TAED and TAMD;

(e) said enzymes are selected from the group consisting of amylase, lipase and protease.

19. A dishwashing composition according to claim 14, wherein:

(a) said nonionic surfactants are selected from the group consisting of polyoxyalkylene condensates of aliphatic alcohols and polyoxyalkyleneoxide block copolymers;

(b) said non-phosphate builders are selected from the group consisting of alkali metal salts of carbonate and bicarbonate, and silicate and citrate;

(c) said non-chlorine bleach is selected from the group consisting of perborate and percarbonate;

(d) said bleach precursors are selected from the group consisting of TAED and TAMD;

(e) said enzymes are selected from the group consisting of amylase, lipase and protease.

20. A dishwashing composition according to claim 15, wherein:

(a) said nonionic surfactants are selected from the group consisting of polyoxyalkylene condensates of aliphatic alcohols and polyoxyalkyleneoxide block copolymers;

(b) said non-phosphate builders are selected from the group consisting of alkali metal salts of carbonate and bicarbonate, and silicate and citrate;

(c) said non-chlorine bleach is selected from the group consisting of perborate and percarbonate;

(d) said bleach precursors are selected from the group consisting of TAED and TAMD;

(e) said enzymes are selected from the group consisting of amylase, lipase and protease.

21. A method for reducing spotting and filming of dishware comprising contacting said dishware with a dishwashing composition according to claim 1.

22. A method for reducing spotting and filming of dishware comprising contacting said dishware with a dishwashing composition according to claim 11.

* * * * *